US005955133A

United States Patent [19]

Bowers et al.

[11] Patent Number: 5,955,133

[45] Date of Patent: Sep. 21, 1999

[54] METHODS FOR WRAPPING SANDWICH TYPE PRODUCTS

[75] Inventors: Debra D. Bowers, Menasha; Jane L. Clough, Neenah; Louann S. Mueller, Little Chute, all of Wis.

[73] Assignee: Fort James Corporation, Richmond, Va.

[21] Appl. No.: 09/035,976

[22] Filed: Mar. 6, 1998

[51] Int. Cl.[6] ..... B65B 65/12

[52] U.S. Cl. ..... 426/410; 426/111; 53/390; 53/461

[58] Field of Search ..... 426/410, 111; 53/390, 461

[56] References Cited

U.S. PATENT DOCUMENTS

| | | | |
|---|---|---|---|
| Re. 35,241 | 5/1996 | Capy et al. | 426/111 |
| 158,064 | 4/1874 | Martin | 53/390 |
| 628,859 | 7/1899 | Sevigne | 53/390 |
| 1,028,498 | 1/1912 | Schneider | 53/390 |
| 1,381,425 | 6/1921 | Oldham | 53/461 |
| 1,661,479 | 3/1928 | Josephson | 53/390 |
| 1,737,055 | 11/1929 | Molins | 53/461 |
| 1,789,699 | 1/1931 | Durham | 53/461 |
| 3,299,612 | 1/1967 | Bernhardt | 53/390 |
| 3,516,228 | 6/1970 | Fellner | 53/390 |
| 3,849,966 | 11/1974 | Preston et al. | 53/390 |
| 4,795,648 | 1/1989 | Capy et al. | 426/111 |
| 5,131,586 | 7/1992 | Capy | 229/87.03 |
| 5,479,761 | 1/1996 | Weder | 53/461 |

OTHER PUBLICATIONS

The Wiley Encyclopedia of Packaging Technology, Copyright 1986, pp. 702–706, "Folding Patterns".

*Primary Examiner*—Nina Bhat

*Attorney, Agent, or Firm*—Burns, Doane, Swecker & Mathis, L.L.P.

[57] ABSTRACT

A method for wrapping sandwich products that include a heel of bread and a crown of bread involves placing the heel of bread on a flat sheet of packaging wrap, placing the crown of bread on the packaging wrap adjacent one of the corners of the packaging wrap, dressing the heel and/or the crown of bread, and then carrying out various folding steps to produce a wrapped or packaged sandwich product. The folding steps include inwardly folding the corner of the packaging wrap on which the crown of bread has been placed together with the crown of bread to position the crown of bread on top of the heel of bread and with the corner of the wrap being positioned in overlying relation to the crown of bread. A second portion of the packaging wrap is then inwardly folded to lie adjacent the folded corner, a third portion of the packaging wrap is inwardly folded to lie adjacent the folded second portion, and then a fourth portion of the packaging wrap is inwardly folded to lie adjacent the folded third portion. The result is a packaged or wrapped sandwich product that is completely enclosed within the packaging wrap.

28 Claims, 10 Drawing Sheets

FIG. 2A
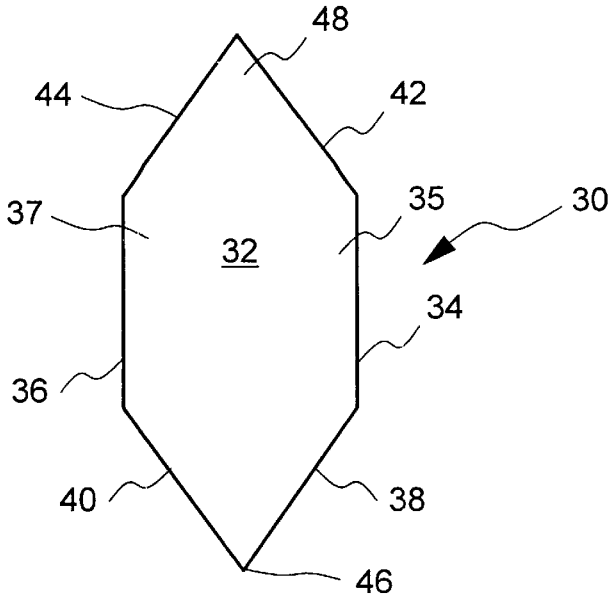
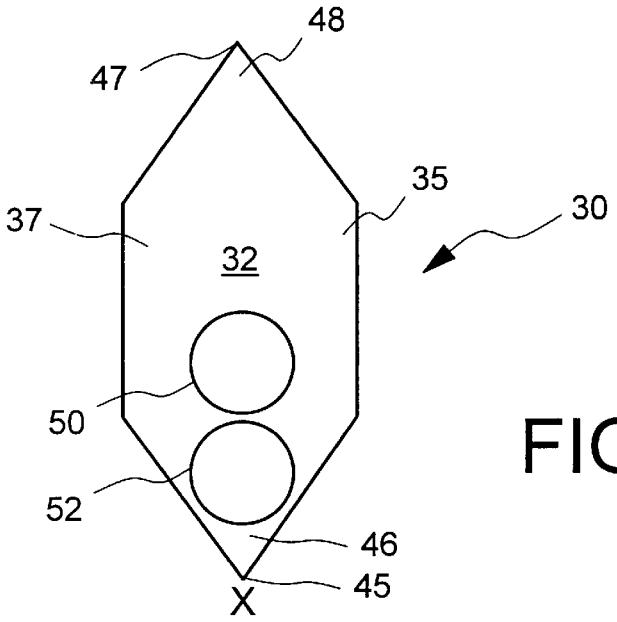
FIG. 2B
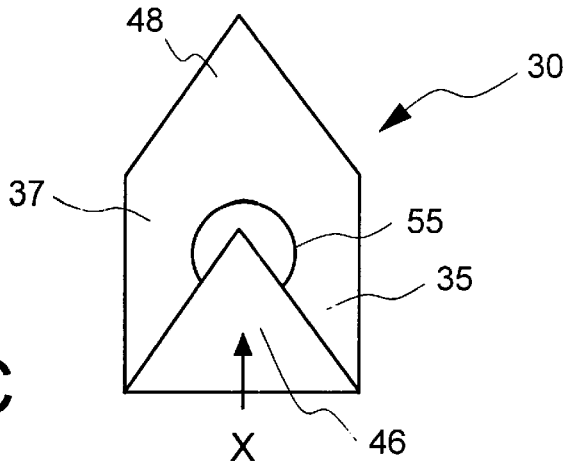
FIG. 2C

METHODS FOR WRAPPING SANDWICH TYPE PRODUCTS

FIELD OF THE INVENTION

The present invention generally relates to the packaging of food products. More particularly, the present invention pertains to methods for wrapping sandwich type products.

BACKGROUND OF THE INVENTION

Food establishments that prepare food items for later sale and consumption by consumers typically package the food products once they have been prepared and then store them so that they can be later sold and carried out by the customer. These establishments use a variety of different types of packaging materials to package the food products, including paperboard cartons and styrofoam containers. While there are certain useful attributes associated with these types of boxes and containers, they also suffer from the significant disadvantage that they are relatively bulky and thus require a significant amount of storage space.

Another type of packaging material that has been used in the past is a sheet of packaging wrap in which the food product can be wrapped. This type of material is preferred in some respects in that it can be stored in a relatively small amount of space. This packaging wrap is oftentimes used in fast food establishments for wrapping and packaging a variety of different food products, including sandwich type products such as hamburgers and the like. In the case of fast food restaurants, for example, sandwich type products of many different types must be prepared and packaged in a quick and efficient manner to meet customer demand. It has been found that the typical techniques employed for wrapping sandwich products are not ideally suited for facilitating fast and efficient wrapping and packaging of sandwich products.

One technique commonly used to wrap sandwich products with a sheet of packaging wrap is schematically illustrated in FIGS. 4A–4D. This technique involves initially positioning a rectangularly shaped wrap 100 on a table or counter so that one side 104 of the wrap faces the preparer. The position of the preparer is identified with an X in FIGS. 4A–4D. A heel and a crown of bread are placed on the wrap, whereupon the crown is dressed and then flipped over onto the heel to form the sandwich 110 as shown in FIG. 4A. To fold the sandwich 110 with the wrap 110, the side 104 facing the preparer is first folded over the sandwich 110 in the direction of the arrow shown in FIG. 4B. Next, the opposite side 108 of the wrap is folded over the sandwich 100 and over the folded side 104 in the direction of the arrow in FIG. 4C to result in the partially folded sandwich shown in FIG. 4C. The corners of the two remaining sides 102, 106, of the wrap 100 are then folded on themselves to form triangles on the sides of the sandwich as seen in FIG. 4D. The opposite sides of the wrap are then tucked under the sandwich as indicated by the arrows in FIG. 4D to produce the finished wrapped sandwich. This wrapping technique is known as the gift wrap style of wrapping.

Another technique for wrapping sandwich products is schematically illustrated in FIGS. 5A–5D and involves orienting the packaging wrap 100 in the same manner noted above so that one side 104 of the wrap faces the preparer. The heel and crown of bread are placed on the wrap 100, with the heel being positioned adjacent the side 104 of the wrap which is nearest to and faces the preparer positioned at point X in FIG. 5A. After the crown of bread is dressed, the crown is flipped over onto the heel to form the sandwich 110.

The wrap 100 with the sandwich product 110 is then rolled up in a direction away from the preparer (i.e., towards the opposite side 108) as shown by the arrow in FIG. 5B. This results in the partially wrapped configuration shown in FIG. 5B. The sandwich 110 and the side 104 are then rolled for a second time over the center of the wrap in the manner depicted by the arrow in FIG. 5C to result in the configuration illustrated in FIG. 5C. As a last step, the sides 102, 106 are tucked under the sandwich in the manner shown by the arrows in FIG. 5D to produce the wrapped sandwich shown in FIG. 5D.

While the above-described techniques are suitable for packaging or wrapping sandwich products, it has been found that they are not particularly well suited for wrapping sandwich type products in the most efficient manner. Increasing the speed and ease with which the sandwich type products can be wrapped improves the overall efficiency of the food service operation. Further, with sandwiches wrapped in accordance with known techniques, the sandwich wrap tends to pop open, particularly during transport from, for example, the wrapping station to the customer. Thus, a need exists for packaging techniques which will maintain the integrity of the sandwich closure while also facilitating the speed and efficiency with which food products such as sandwich type products can be packaged for later sale to and consumption by customers.

SUMMARY OF THE INVENTION

According to one aspect of the invention, a method for wrapping sandwich products involves placing a heel of bread on a flat sheet of packaging wrap having a plurality of sides, placing a crown of bread on the flat sheet of packaging wrap on a first portion of the packaging wrap located adjacent a corner at which two adjacent sides intersect, and then folding various portions of the packaging wrap. The folding includes inwardly folding the first portion of the packaging wrap, including the corner, together with the crown of bread to place the crown of bread on top of the heel of bread with the first portion being positioned in overlying relation to the crown of bread. A second portion of the packaging wrap is folded inwardly to lie adjacent the folded first portion, and then a third portion of the packaging wrap is folded inwardly to lie adjacent the folded second portion.

According to another aspect of the invention, a method by which a preparer wraps a sandwich product involves initially placing on a surface a sheet of packaging wrap having a plurality of corners, with the packaging wrap being oriented relative to the preparer so that one of the corners faces the preparer. First and second pieces of bread product are then placed on the packaging wrap. A first folding step is performed involving folding a first portion of the packaging material along with the second piece of bread product to position the second piece of bread product and the first piece of bread product in overlying relation to one another and with the first portion of the packaging wrap being folded with respect to a remainder of the packaging wrap so that the first portion of the packaging wrap is positioned against the second piece of bread product. A second folding step is performed to position a second portion of the packaging wrap adjacent the folded first portion of the packaging wrap and a third folding step is performed to position a third portion of the packaging wrap adjacent the folded second portion of the packaging wrap.

In accordance with another aspect of the invention, a method by which a preparer wraps a sandwich product involves placing a flat sheet of packaging wrap on a surface, with the flat sheet of packaging wrap including at least one corner and the flat sheet of packaging wrap being positioned on the surface so that the corner faces the preparer. First and second pieces of bread product are then placed on the flat sheet of packaging wrap, with the second piece of bread product being positioned on a portion of the packaging wrap located adjacent the corner that faces the preparer. The first portion of the packaging wrap, including the corner, is then folded inwardly together with the second piece of bread product to position the second piece of bread product and the first piece of bread product in overlying relation to one another to form a sandwich product and with the first portion of the packaging wrap being positioned in overlying relation to the sandwich product. A second portion of the packaging wrap and a third portion of the packaging wrap are then inwardly folded.

According to a still further aspect of the invention, a method for wrapping sandwich products includes placing a flat sheet of packaging wrap on a surface, with the flat sheet of packaging wrap having oppositely located first and second corners and oppositely located first and second sides. The packaging wrap is configured to have dimensions such that the dimension between the first and second corners is greater than the dimension between the first and second sides. A first piece of bread product is placed on the packaging wrap and a second piece of bread product is also placed on the flat sheet of packaging wrap at a first portion of the packaging wrap located adjacent the first corner. The first portion of the packaging wrap is folded along with the second piece of bread product to position the second piece of bread product on top of the first piece of bread product to form a sandwich product and with the first portion of the packaging wrap being positioned on top of the sandwich product. Second and third portions of the packaging wrap are then folded.

BRIEF DESCRIPTION OF THE DRAWING FIGURES

The foregoing and additional features and characteristics of the present invention will become more readily apparent from the following detailed description considered with reference to the accompanying drawing figures in which like elements are designated by like reference numerals and wherein:

FIG. 2A is a plan view of a sheet of packaging wrap used to package a sandwich type product in accordance with a second technique of the present invention;

FIG. 2B is a plan view of the packaging wrap shown in FIG. 2A illustrating two bread pieces that have been placed on the wrap in preparation for dressing and packaging;

FIG. 2C is a plan view of the packaging wrap shown in FIG. 2B illustrating a first folding step;

DETAILED DESCRIPTION OF THE INVENTION

Figure 1A:
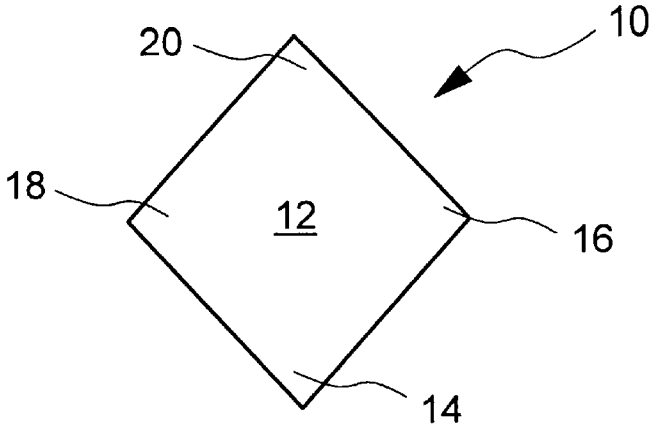
FIG. 1A is a plan view of a sheet of packaging wrap used to package a sandwich type product in accordance with a first technique of the present invention.

With reference initially to FIGS. 1A–1G, one technique for quickly and efficiently wrapping sandwich type products in accordance with the present invention involves the use of a flat sheet of packaging wrap 10. As seen in FIG. 1A, the packaging wrap 10 includes a center, a first corner portion 14, a second corner portion 16, a third corner portion 18 and a fourth corner portion 20. The packaging wrap 10 is generally in the form of a square, with adjacent sides of the square packaging wrap intersecting at respective corners.

Figure 1B:
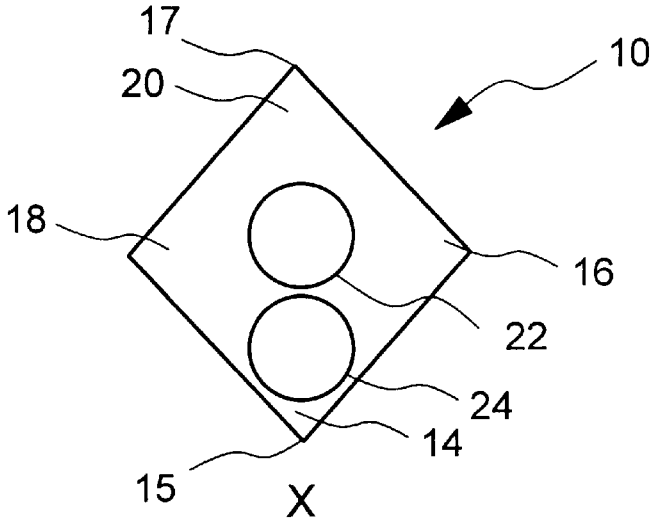
FIG. 1B is a plan view of the packaging wrap shown in FIG. 1A illustrating two bread pieces that have been placed on the wrap in preparation for dressing and packaging.

The first step in utilizing the packaging wrap 10 illustrated in FIG. 1A according to one packaging or wrapping technique of the present invention is illustrated in FIG. 1B. The packaging wrap 10 is positioned in a specific orientation relative to the preparer. In particular, the packaging wrap 10 is positioned so that one of the corners 15 is pointing directly at the preparer who is positioned at a location identified as X during the wrapping or packaging procedure. Stated differently, an imaginary line passing through the oppositely positioned corners 15 and 17 will pass through the preparer. It has been found that by positioning or orienting the packaging wrap 10 in this way relative to the preparer, and then carrying out the wrapping techniques described below, the sandwich type product can be more quickly and easily wrapped, thereby increasing the efficiency of the food product preparation and packaging process.

As also shown in FIG. 1B, once the packaging wrap 10 is positioned in the illustrated manner relative to the preparer, a heel of bread 22 and a crown of bread 24 are placed on the flat sheet of packaging wrap 10. The heel of bread 22 is generically referred to as a first bread piece while the crown of bread 24 is generically referred to as a second bread piece. The heel of bread 22 and the crown of bread 24 can be, for example, the bottom and top bread pieces of a hamburger bun, the bottom and top pieces of a croissant roll, the bottom and top pieces of bread slices, the bottom and top pieces of a muffin, or the bottom and top of any other bread item for making a sandwich type product.

As illustrated in FIG. 1B, the first bread piece 22 is positioned in the center of the sheet of packaging wrap 10 while the second bread piece 24 is positioned adjacent the first corner portion 14 of the sheet of packaging wrap 10. The sheet of packaging wrap 10 and the first and second bread pieces 22, 24 are positioned so that the second bread piece 24 is positioned closest to the individual preparing and packaging the sandwich type product. It is also to be understood that the positions of the bottom and top pieces of bread items for forming the sandwich type product can be switched.

Once the first and second bread pieces 22, 24 are positioned in the manner illustrated in FIG. 1B, the sandwich type product is dressed. That is, the desired food items are placed on the first and/or second bread pieces. For example, in the case of a hamburger, the meat patty and other desired items such as lettuce, tomato, onion, and condiments (e.g., catsup, mustard, mayonnaise, etc.) are appropriately positioned on the first bread piece 22 and/or the second bread piece 24. This dressing could also be performed prior to placing the bread pieces 22, 24 on the packaging wrap.

Figure 1C:
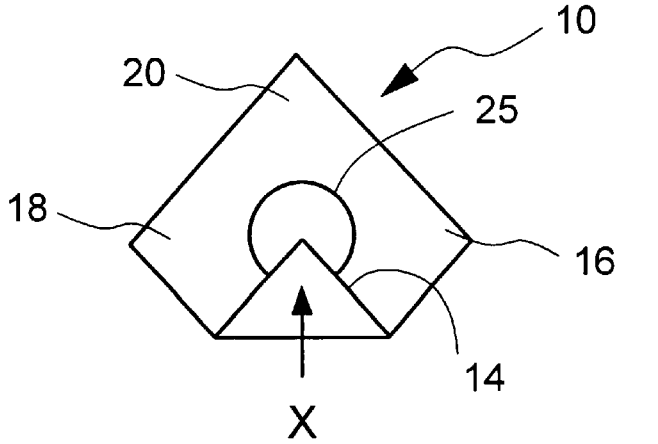
FIG. 1C is a plan view of the packaging wrap shown in FIG. 1B illustrating a first folding step.

FIG. 1C illustrates the first folding step for packaging or wrapping the sandwich type product according to a first technique of the present invention. The first folding step involves the preparer grasping the first corner portion 14 of the packaging wrap 10 along with the second bread piece 24, and folding the two together. This folding is performed in a direction away from the preparer and towards the fourth corner portion 20 as depicted by the arrow. During this folding, the first bread piece 24 and the first corner portion 14 of the packaging wrap 10 are flipped together over the first bread piece 22 so that the second bread piece 24 is placed on top of the first bread piece 22. The sandwich type product 25 is thus formed. As shown in FIG. 1C, after completion of this first folding step, the first corner portion 14 of the packaging wrap 10 overlies the sandwich type product 25 and is positioned in contact with the second bread piece 24.

Figure 1D:
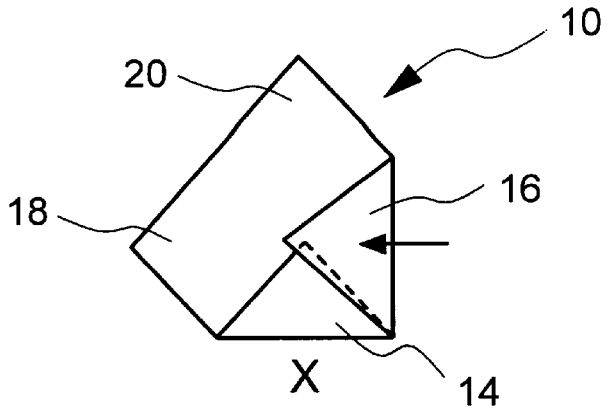
FIG. 1D is a plan view of the packaging wrap shown in FIG. 1C illustrating a second folding step.

The second folding step illustrated in FIG. 1D involves inwardly folding the second corner portion 16 towards the third corner portion 18 in the direction indicated by the arrow. The preparer thus folds the second corner portion 16 over his/her thumb and the sandwich type product, using his/her thumb as a guide. Once this folding step is completed, the second corner portion 16 overlies the folded first corner portion 14.

Figure 1E:
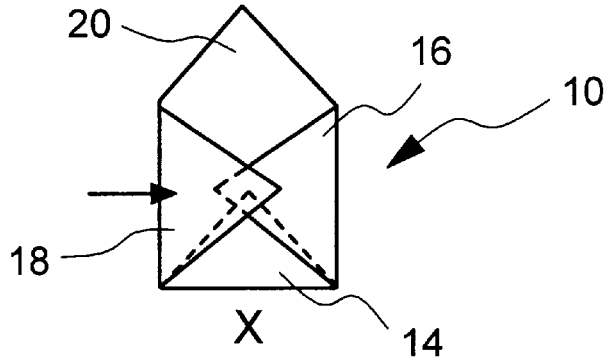
FIG. 1E is a plan view of the packaging wrap shown in FIG. 1D illustrating a third folding step.

In the third folding step illustrated in FIG. 1E, the third corner portion 18 is folded inwardly in the direction of the second corner portion 16 as indicated by the illustrated arrow. During this folding, the third corner portion 18 is folded over the preparer's thumb and sandwich type product, with the preparer's thumb once again being used as a fold guide. Upon completion of this third folding step, the third corner portion 18 overlies the second corner portion 16. Also, it is to be recognized that the second and third folding steps could be interchanged with one another so that the third corner portion 18 is folded inwardly after the first folding step, followed by inward folding of the second corner portion 16.

Figure 1F:
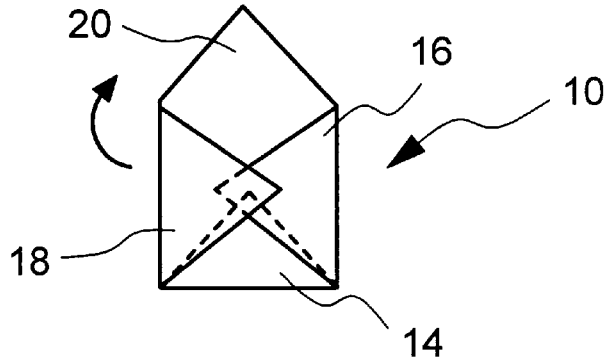
FIG. 1F is a plan view of the packaging wrap shown in FIG. 1E illustrating a fourth folding step.

In the fourth and final folding step illustrated in FIG. 1F, folding of the fourth corner portion 20 relative to the remainder of the wrapped product is effected. In this step, the preparer flips the entire partially wrapped sandwich type product, i.e., the sandwich type product and the first, second and third folded corner portions, 14, 16, 18, over on top of the fourth corner portion 20 so that the sandwich type product thus rests on the second bread piece or crown of bread 24. This final folding of the sandwich type product is illustrated by the arrow in FIG. 1F.

Figure 1G:
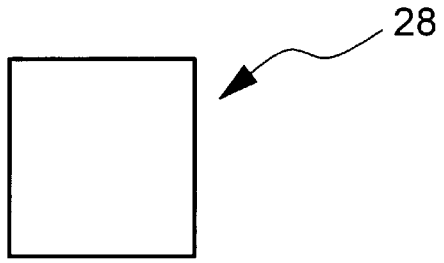
FIG. 1G is a plan view of the packaged sandwich type product after completion of the folding step shown in FIG. 1F.

FIG. 1G illustrates the sandwich type product completely enclosed in the packaging wrap after the final folding step is completed to result in a packaged sandwich type product 28. The wrapped sandwich type product 28 can then be stored in the manner illustrated in FIG. 1G with the folded corner portions 14, 16, 18, 20 positioned underneath the sandwich type product. Because the sandwich type product enclosed within the packaging wrap rests on top of the folded corner portions 14, 16, 18, 20, the weight of the sandwich type product will maintain the packaging wrap in a closed state.

To open the sandwich type product, the wrapped sandwich type product is flipped over so that the second bread piece or crown of bread 24 is once again on top. The folded corner portions 14, 16, 18, 20 can then be easily unfolded to unwrap the sandwich type product.

It has been found that utilization of the wrapping technique described above, including positioning the packaging wrap 10 so that the corner of the wrap nearest the preparer faces and points directly at the preparer and then placing one of the bread pieces on the corner of the wrap facing the preparer, the subsequent folding steps can be relatively quickly performed in a shorter amount of time than other known techniques and in a more efficient manner than other techniques. In the present invention, the crown of bread or second bread piece 24 is placed on top of the heel of bread or first bread piece 22 at the same time as a portion of the packaging wrap is folded. Thus, two different steps are not required as is the case with the other known techniques described above. Also, the overall folding process is easier and more simple than other known techniques. The preparer is able to grasp and fold corners of the packaging wrap rather than sides of the wrap and it is believed that this helps facilitate the packaging or wrapping process.

The packaging wrap 10 used in the packaging and wrapping technique illustrated in FIGS. 1A–1G can be sized to accommodate the dimensions of the sandwich type product being wrapped. By way of example, for wrapping, for example, hamburgers, it has been found that a packaging wrap having 12 inch sides is preferable.

A second technique for wrapping sandwich type products is illustrated in FIGS. 2A–2H. This alternative packaging or wrapping technique involves the use of the packaging wrap 30 illustrated in FIG. 2A. The packaging wrap 30 is a flat sheet of packaging wrap having a center 32 and a plurality of sides 34, 36, 38, 40, 42, 44 that together define a hexagonally shaped packaging wrap. The packaging wrap 30 also includes oppositely located first and second corner portions 46, 48, and oppositely located first and second side portions 35, 37. The hexagonally shaped packaging wrap 30 is elongated in one direction so that the distance between the corner at which the sides 42 and 44 intersect and the corner at which the sides 38 and 40 intersect is greater than the distance between the oppositely located sides 34, 36.

As illustrated in FIG. 2B, the first step in packaging a sandwich type product through use of the packaging wrap 30 shown in FIG. 2A involves orienting the packaging wrap 30 relative to the preparer (whose position is once again identified by X in FIG. 2B) in the illustrated manner so that the corner 45 at one of the ends of the wrap 30 is pointed directly in the direction of the preparer. Stated another way, the packaging wrap 30 is oriented relative to the preparer such that an imaginary line passing through the oppositely located corners 45 and 47 will also pass through the preparer.

Once the packaging wrap 30 is oriented in this manner, a heel of bread 50 is placed on the flat sheet of packaging wrap and a crown of bread 52 is placed on the packaging wrap 30. The heel of bread 50 is generically referred to as a first bread piece while the crown of bread 52 is generically referred to as a second bread piece. As mentioned above, the heel of bread 50 and the crown of bread 52 can be, for example, the bottom and top bread pieces of a hamburger bun, the bottom and top pieces of a croissant roll, the bottom and top pieces of bread slices, the bottom and top pieces of a muffin, or the bottom and top of any other bread item for making a sandwich type product.

As illustrated in FIG. 2B, the first bread piece 50 is positioned on the flat sheet of packaging wrap 30 at a position offset from the center 32 of the packaging wrap 30 while the second bread piece 52 is positioned adjacent the first corner portion 46 of the packaging wrap 30. The sheet of packaging wrap 30 and the first and second bread pieces 50, 52 are positioned so that the second bread piece 52 is positioned closest to the preparer. It is to be recognized that the positions of the first and second bread pieces 50, 52 items for forming the sandwich type product can be reversed.

Once the first and second bread pieces 50, 52 have been placed on the packaging wrap 30, one or both of the bread pieces can be dressed with the necessary food items for making the desired sandwich type product. This dressing step could also be performed prior to placing the bread pieces 50, 52 on the packaging wrap 30.

After the first and second bread pieces 50, 52 have been dressed, the first folding step illustrated in FIG. 2C is performed. In this first folding step, the preparer grasps the first corner portion 46 of the packaging wrap 30 together with the second bread piece 52 and folds the two together to place the second bread piece 52 on top of the first bread piece 50. This folding is performed in the direction of the arrow shown in FIG. 2C and results in the formation of the sandwich type product 55. After this folding step, the first corner portion 46 of the packaging wrap 30 overlies the sandwich type product 55 and is in contact with the second bread piece 52.

Figure 2D:
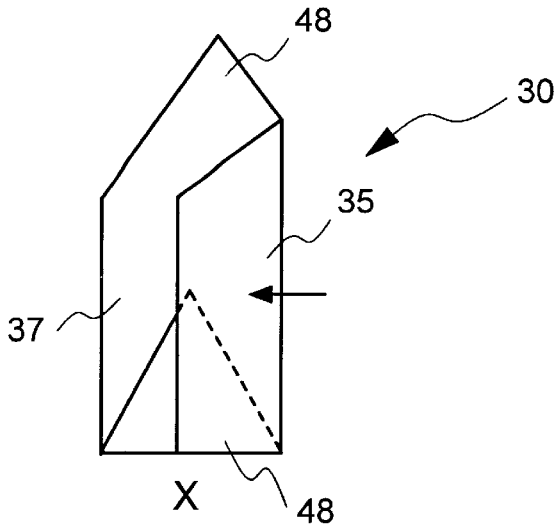
FIG. 2D is a plan view of the packaging wrap shown in FIG. 2C illustrating a second folding step.

The second folding step which is illustrated in FIG. 2D involves inwardly folding the first side portion 35 in the direction towards the second side portion 37 as indicated by the arrow in FIG. 2D. The first side portion 35 is folded over the sandwich type product and over the preparer's thumb, with the preparer's thumb being used as a fold guide. The first side portion 35 of the packaging wrap 30 is folded over so that it overlies the first corner portion 48 of the packaging wrap. Thus, the first corner portion 48 of the packaging wrap 30 is positioned between the sandwich type product and the first side portion 35 of the packaging wrap 30.

Figure 2E:
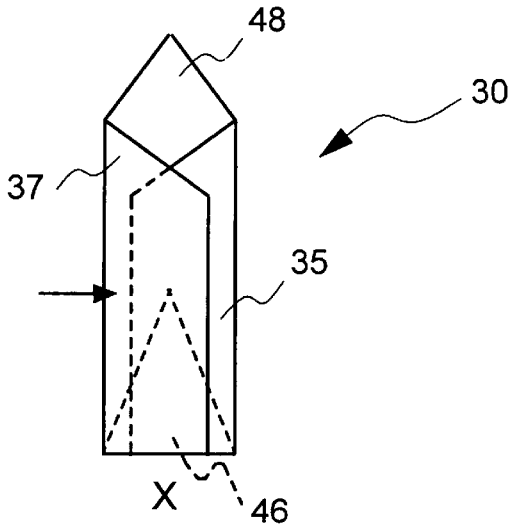
FIG. 2E is a plan view of the packaging wrap shown in FIG. 2D illustrating a third folding step.

The third folding step is illustrated in FIG. 2E and involves inwardly folding the second side portion 37 of the packaging wrap 30 in the direction of the first folded side portion 35 as indicated by the illustrated arrow. This folding is once again performed over the preparer's thumb while using the preparer's thumb as a fold guide so that the second side portion 37 overlies the sandwich type product. As in the case of the technique described above, it is possible to interchange the order in which the first and second side portions 35, 37 are folded so that the second side portion 37 is folded inwardly after the first folding step, followed by inward folding of the first side portion 35. After this third folding step illustrated in FIG. 2E, the folded first side portion 35 is positioned between the folded first corner portion 46 and the folded second side portion 37.

Figure 2F:
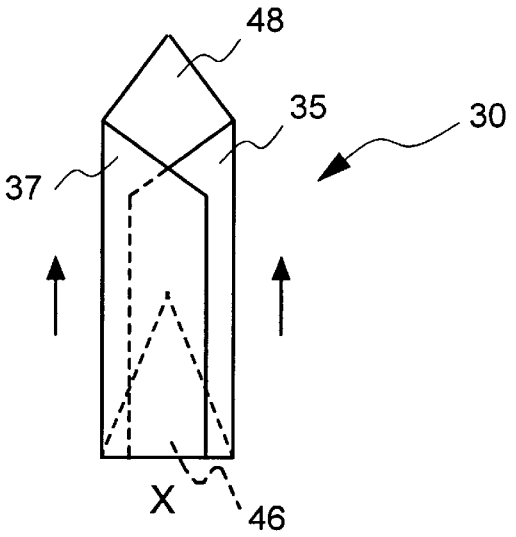
FIG. 2F is a plan view of the packaging wrap shown in FIG. 2E illustrating a creasing step in which sides of the packaging wrap are creased.

As the preparer moves to grasp the second corner portion 48 to effect the final folding step, the preparer can crease down the folded first and second side portions 35, 37 in the manner schematically illustrated by the arrows in FIG. 2F.

Figure 2G:
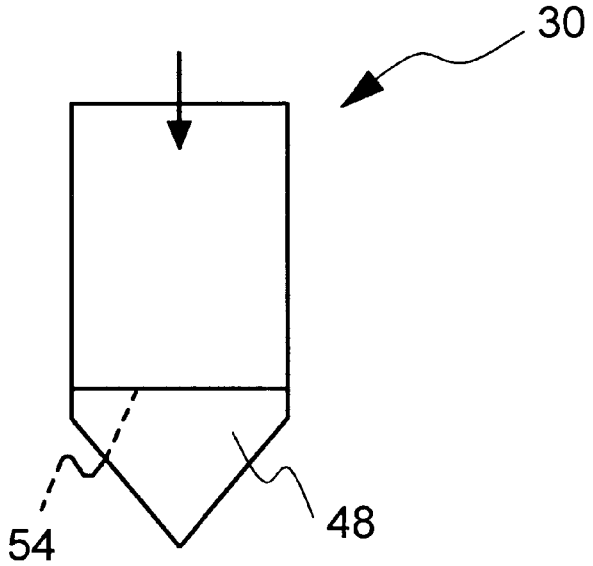
FIG. 2G is a plan view of the packaging wrap shown in FIG. 2F illustrating a fourth folding step.

The final folding step is illustrated in FIG. 2G and involves inwardly folding the second corner portion 48 of the packaging wrap 30 towards the folded first corner portion 46 as indicated by the arrow. This folding is performed so that an end part of the folded second corner portion 48 extends beyond the edge 54 of the package as shown in FIG. 2G. This projecting end part of the second corner portion 48 forms a flap that can be tucked under the folds formed by the folded first and second side portions 35, 37 of the packaging wrap 30. That is, the projecting end part of the second corner portion 48 can either be tucked underneath the folded first side portion 35 so as to be located between the folded first corner portion 46 and the folded first side portion 35, or can be tucked underneath the folded second side portion 37 so as to be located between the first and second folded side portions 35, 37. The result is the packaged sandwich type product 56 illustrated in FIG. 2H.

By virtue of the folding technique illustrated in FIGS. 2A–2H, the various folded portions of the packaging wrap are not liable to become unfolded during storage of the packaged food product. Further, the packaged sandwich type product can be stored with the crown of bread or second bread piece 52 facing upwardly, and the sandwich can be served in that orientation.

Figure 2H:
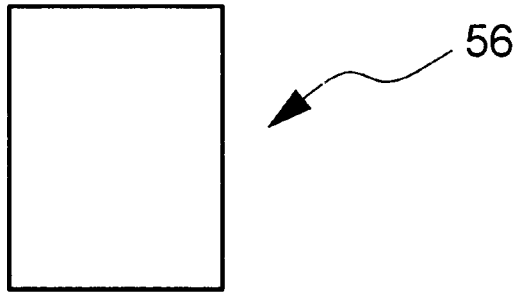
FIG. 2H is a plan view of the packaged sandwich type product after completion of the folding step shown in FIG. 2G and after the end of the last folded portion has been tucked in place along one side of the package.

To open the packaged product illustrated in FIG. 2H, the flap part of the second corner portion 48 can simply be untucked to allow the folded side portions 35, 37 and the folded corner portions 46, 48 of the packaging wrap 30 to be opened for exposing the sandwich type product.

The packaging or wrapping technique illustrated in FIGS. 2A–2H provides advantages similar to those described above with respect to the first technique. In addition, the elongated hexagonal shape of the packaging wrap sheet makes it possible to form the flap that can then be tucked in place as described above.

Although the packaging wrap illustrated in FIG. 2A can be dimensioned with any suitable dimensions to accommodate the size of the sandwich type product being wrapped, it has been found useful to dimension the packaging wrap so that the sides 34, 36 possess a length of 5¼ inches and the sides 38, 40, 42, 44 possess a length of 9 inches, and so that the distance between the sides 34, 36 is 13 inches and the distance between the corner formed by the intersection of the sides 42, 44 and the corner formed by the intersection of the sides 38, 40 is 18¼ inches.

FIGS. 3A–3I illustrate a third technique according to the present invention for packaging sandwich type products. This third technique involves the use of a flat sheet of packaging wrap 60 having a square configuration and including a center region 62, a first corner portion 64, a second corner portion 66, a third corner portion 68, and a fourth corner portion 70. The first and fourth corner portions 64, 70 are positioned opposite one another while the second and third corner portions 66, 68 are positioned opposite one another.

Figure 3A:
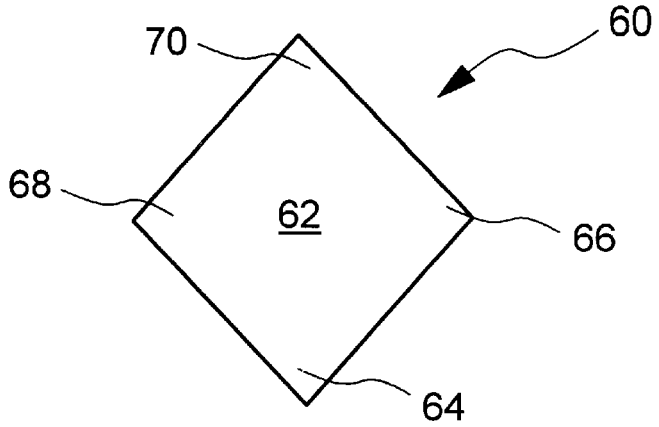
FIG. 3A is a plan view of a sheet of packaging wrap used to package a sandwich type product in accordance with a third technique of the present invention.
Figure 3B:
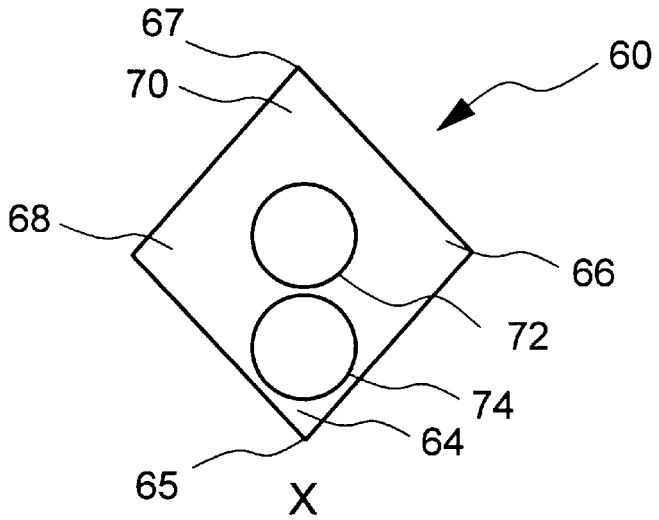
FIG. 3B is a plan view of the packaging wrap shown in FIG. 3A illustrating two bread pieces that have been placed on the wrap in preparation for dressing and packaging.

As illustrated in FIG. 3B, the packaging of a sandwich type product utilizing the packaging wrap 60 shown in FIG. 3A involves first positioning and orienting the packaging wrap 60 relative to the preparer in the manner shown in FIG. 3B, the position of the preparer being identified by X. In this embodiment, as in the other embodiments, the packaging wrap 60 is positioned so that one of the corners 65 is pointed directly at the preparer whose position during the packaging or wrapping process is once again identified by X. In other words, an imaginary line passing through the oppositely located corners 65, 67 will also pass through the preparer.

After the packaging wrap 60 is positioned in the manner shown in FIG. 3B, the preparer places a heel of bread 72 on the packaging wrap 60 and places a crown of bread 74 on the packaging wrap 60. The heel of bread 72 is generically referred to as a first bread piece while the crown of bread 74 is generically referred to as a second bread piece. In a manner similar to that noted above, the heel of bread 72 and the crown of bread 74 can be the top and bottom pieces of any bread item for making a sandwich type product such, for example, the bottom and top bread pieces of a hamburger bun, the bottom and top pieces of a croissant roll, the bottom and top pieces of bread slices, and the bottom and top pieces of a muffin.

As illustrated in FIG. 3B, the first bread piece 72 is positioned in the center 62 of the packaging wrap 60 while the second bread piece 74 is positioned adjacent the first corner portion 64 of the packaging wrap 60. The sheet of packaging wrap 60 and the first and second bread pieces 72, 74 are positioned so that the second bread piece 74 is positioned closest to the preparer. It is also to be understood that the positions of the first and second bread pieces 72, 74 illustrated in FIG. 3B can be reversed. Also, after the first and second bread pieces 72, 74 have been placed on the packaging wrap 60, the bread pieces 72, 74 can be dressed with the necessary food items for making the desired sandwich type product, although such dressing could also be performed prior to placing the bread pieces 72, 74 on the packaging wrap 60.

Figure 3C:
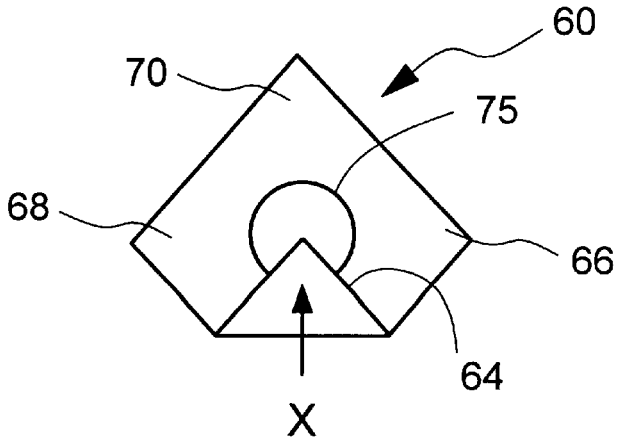
FIG. 3C is a plan view of the packaging wrap shown in FIG. 3B illustrating a first folding step.

The first folding step associated with this version of the packaging or wrapping technique of the present invention is illustrated in FIG. 3C and involves inwardly folding the first corner portion 64 of the packaging wrap 60 along with the second bread piece 74 so that the second bread piece 74 is stacked on top of the first bread piece 72. This thus forms the sandwich type product 75. After this folding step, which is performed in the direction of the arrow illustrated in FIG. 3C, the first corner portion 64 of the packaging wrap 60 overlies and contacts the second bread piece 74.

Figure 3D:
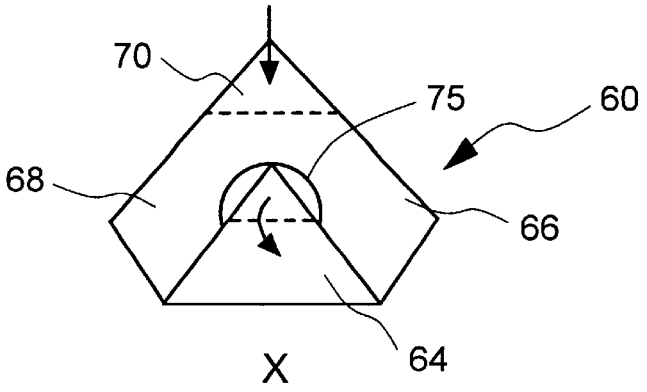
FIG. 3D is a plan view of the packaging wrap shown in FIG. 3C illustrating a second folding step.
Figure 3E:
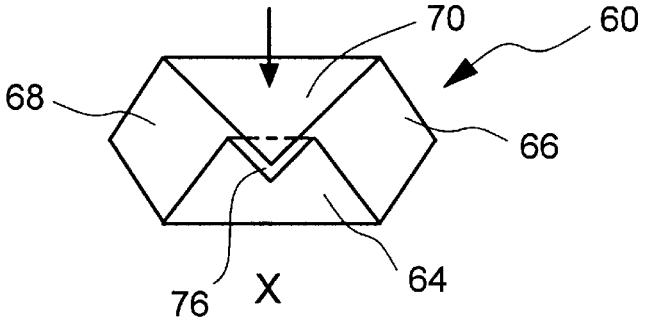
FIG. 3E is a plan view of the packaging wrap shown in FIG. 3D illustrating the way in which a portion of the first folded corner is folded back on itself during the second folding step.

FIGS. 3D and 3E illustrate the folding operations associated with the second folding step. Here, the end part 76 of the folded first corner portion 64 is folded back upon itself to create a flap. In addition, the fourth corner portion 70 of the packaging wrap 60 is folded inwardly towards the folded first corner portion 64. This folding of the fourth corner portion 70 results in the folded flap 76 being positioned between the folded fourth corner portion 70 and the remainder of the folded first corner portion 64 as illustrated in FIG. 3E.

Figure 3F:
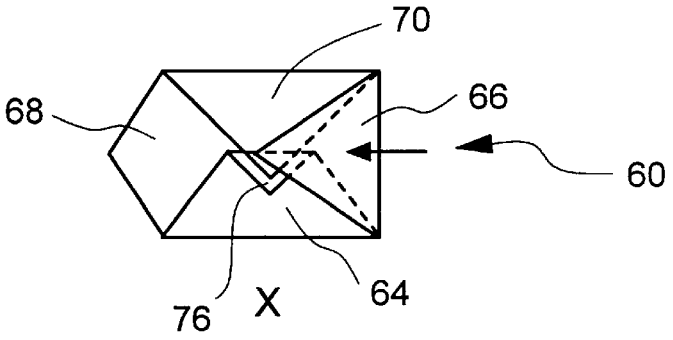
FIG. 3F is a plan view of the packaging wrap shown in FIG. 3E illustrating a third folding step.

In the third folding step illustrated in FIG. 3F, the second corner portion 66 is folded inwardly towards the fourth corner portion 68 in the direction of the illustrated arrow. Upon folding, the second corner portion 66 overlies the folded fourth corner portion 70.

Figure 3G:
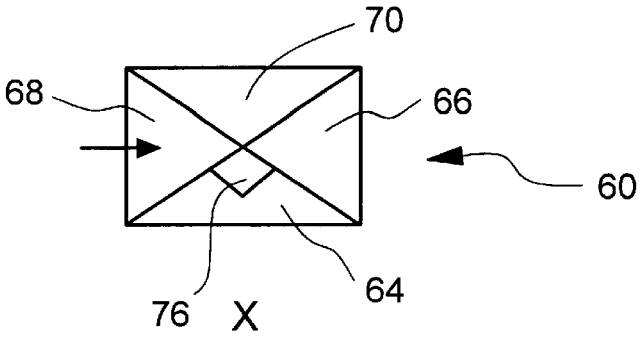
FIG. 3G is a plan view of the packaging wrap shown in FIG. 3F illustrating a fourth folding step.

The fourth folding step illustrated in FIG. 3G involves inwardly folding the third corner portion 68 towards the folded second corner portion 66 in the direction of the illustrated arrow. After this fourth folding step is completed, the folded flap 76 is exposed and available for grasping. It is to be recognized that the third and fourth folding steps can be interchanged, with the third corner portion 68 being folded inwardly followed by inward folding of the second corner portion.

Figure 3H:
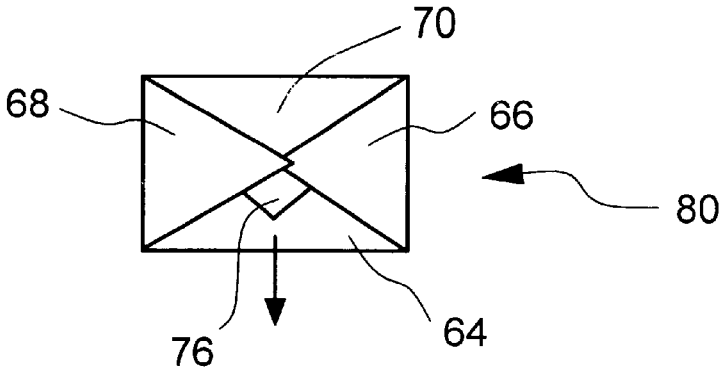
FIG. 3H is a plan view of the packaged sandwich type product after completion of the folding step shown in FIG. 3G, illustrating the pull out flap that can be pulled out to open the package.
Figure 3I:
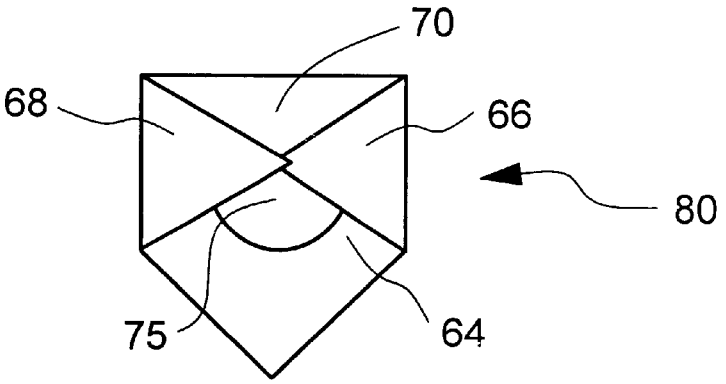
FIG. 3I is a plan view of the package shown in FIG. 3H illustrating the packaged in an open state after the pull out flap has been pulled out.
Figure 4A:
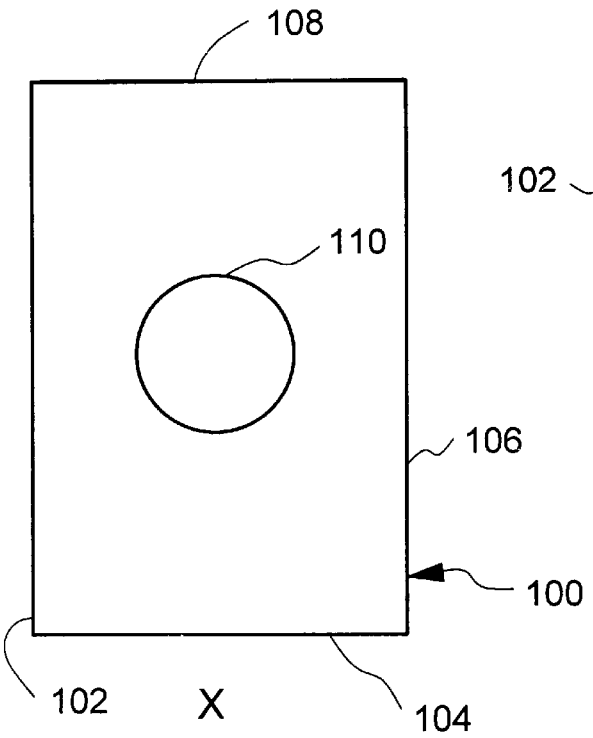
FIG. 4A PRIOR ART
FIG. 4A is a plan view of a sheet of a packaging wrap used to package a sandwich in accordance with a known technique, illustrating placement of the sandwich on the wrap.
Figure 4B:
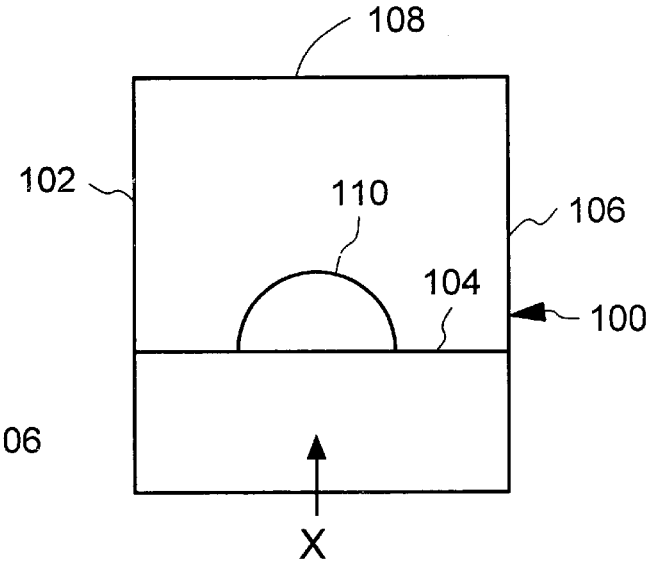
FIG. 4B PRIOR ART
FIG. 4B is a plan view of the packaging wrap shown in FIG. 4A illustrating the sandwich and wrap after completion of a first wrapping step.
Figure 4C:
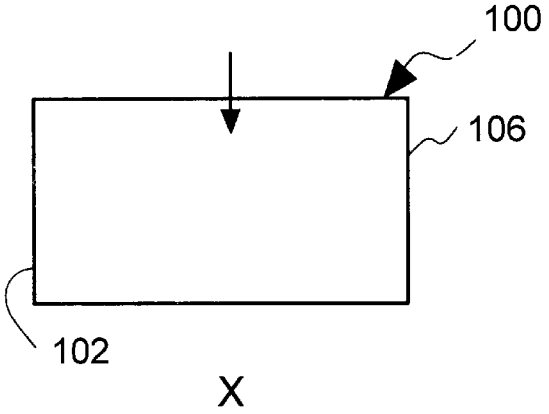
FIG. 4C PRIOR ART
FIG. 4C is a plan view of the packaging wrap shown in FIG. 4B illustrating the wrap after completion of another wrapping step.
Figure 4D:
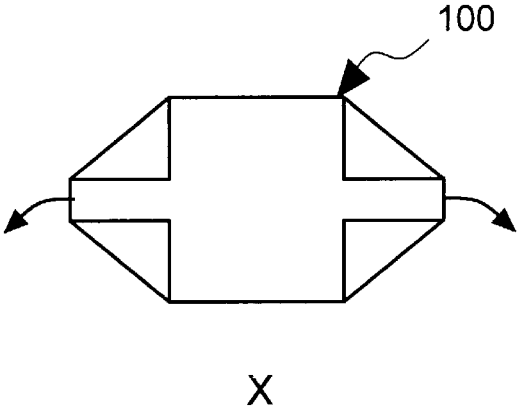
FIG. 4D PRIOR ART
FIG. 4D is a plan view of the packaging wrap shown in FIG. 4C illustrating the wrap after completion of a further wrapping step.
Figure 5A:
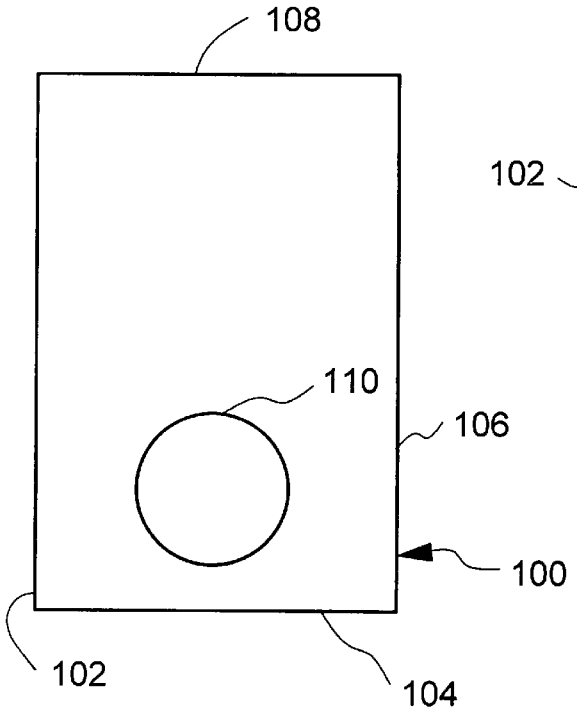
FIG. 5A PRIOR ART
FIG. 5A is a plan view of a sheet of a packaging wrap used to package a sandwich in accordance with another known technique, illustrating placement of the sandwich on the wrap.
Figure 5B:
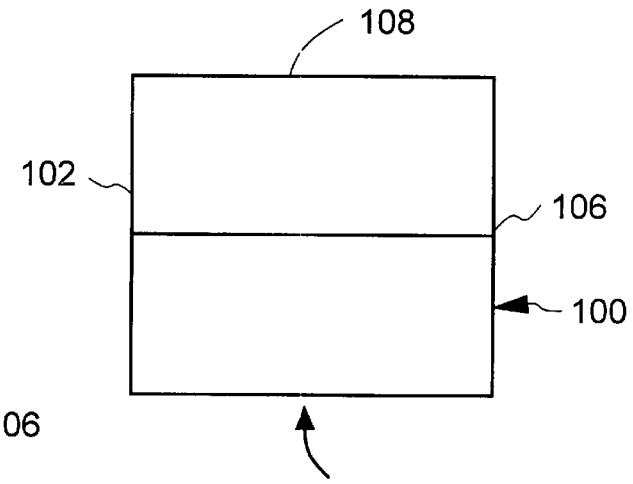
FIG. 5B PRIOR ART
FIG. 5B is a plan view of the packaging wrap shown in FIG. 5A illustrating the sandwich and wrap after completion of a first wrapping step.
Figure 5C:
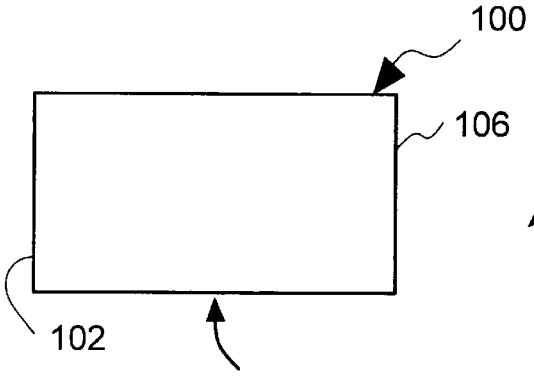
FIG. 5C PRIOR ART
FIG. 5C is a plan view of the packaging wrap shown in FIG. 5B illustrating the wrap after completion of another wrapping step.
Figure 5D:
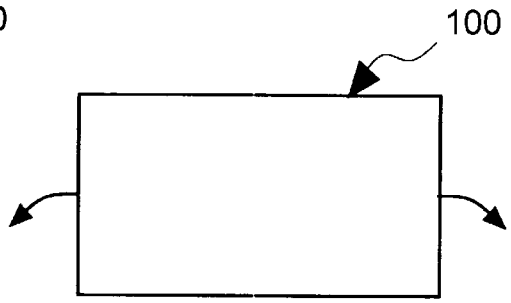
FIG. 5D PRIOR ART
FIG. 5D is a plan view of the packaging wrap shown in FIG. 5C illustrating the wrap after completion of the final wrapping step.

Completion of the fourth folding step results in the packaged sandwich type product 80 illustrated in FIG. 3H. To open the packaged sandwich type product 80, the folded flap 76 can be pulled in the direction of the arrow shown in FIG. 3H to thereby open the folded first corner portion 64. The sandwich type product 75 is thus exposed in the manner illustrated in FIG. 3I.

It can thus be seen that by virtue of the packaging technique illustrated in FIGS. 3A–3I, advantages similar to those described above in connection with the other embodiments can be realized through the particular positioning of the packaging wrap relative to the preparer and the subsequent folding operation. In addition, the folding technique results in the formation of a pouch or pocket in which the sandwich type product is stored upon pulling out the flap 76. Once the package is in the opened state illustrated in FIG. 3I, the first corner portion 64 can be folded back and the sandwich type product 75 eaten directly out of the pouch or pocket.

The present invention thus provides several techniques for quickly and efficiently wrapping sandwich type products. The packaging techniques are relatively simple to carry out and are thus well suited for use in food service establishments which require the preparation and packaging of sandwich type products in as short an amount of time as possible. In each of the wrapping or packaging techniques described above, it is preferable that the packaging wrap be maintained in substantially the same orientation relative the preparer during all of the folding steps.

The principles, preferred embodiments and modes of wrapping of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. Method for wrapping sandwich products that include a heel of bread and a crown of bread, comprising:

placing the heel of bread on a flat sheet of packaging wrap having a plurality of sides;

placing the crown of bread on the flat sheet of packaging wrap on a first portion of the packaging wrap located adjacent a corner at which two adjacent sides intersect;

inwardly folding said first portion of the packaging wrap, including said corner, together with the crown of bread to place the crown of bread on top of the heel of bread with said first portion being positioned in overlying relation to the crown of bread;

inwardly folding a second portion of the packaging wrap to lie adjacent the folded first portion; and inwardly folding a third portion of the packaging wrap to lie adjacent the folded second portion.

2. Method according to claim 1, including inwardly folding a fourth portion of the packaging wrap to lie adjacent the folded third portion.

3. Method according to claim 1, including dressing at least one of the heel of the bread and the crown of the bread with food product after placing the heel of bread on the packaging wrap.

4. Method according to claim 1, wherein the packaging wrap includes a center and said step of placing the heel of bread on the flat sheet of packaging wrap includes placing the heel of bread substantially in the center of the packaging wrap.

5. Method according to claim 2, wherein the packaging wrap possesses a square shape having a plurality of corners, said corner being a first corner, said step of inwardly folding the second portion of the packaging wrap including inwardly folding a second one of said plurality of corners, said step of inwardly folding the third portion of the packaging wrap including inwardly folding a third one of said plurality of corners, said step of inwardly folding the fourth portion of the packaging wrap including inwardly folding a fourth one of said plurality of corners, said fourth corner being located opposite said first corner.

6. Method according to claim 2, wherein said step of inwardly folding a fourth portion of the packaging wrap to lie adjacent the folded third portion includes turning over onto the fourth portion the heel of bread and the crown of bread along with the folded first, second and third portions of the packaging wrap so that the heel of bread, the crown of bread and the first, second and third portions of the packaging wrap overlie the fourth portion of the packaging wrap.

7. Method according to claim 2, wherein said corner is a first corner, said packaging wrap having six sides including oppositely located first and second sides, said packaging wrap having a second corner locates opposite said first corner, a distance between the first and second corners being greater than a distance between the first and second sides, said step of inwardly folding the second portion of the packaging wrap including folding the first side in a direction towards the second side, said step of inwardly folding the third portion of the packaging wrap including folding the second side of the packaging wrap on top of the folded first side of the packaging wrap, said step of inwardly folding the fourth portion of the packaging wrap including folding the second corner of the packaging wrap on top of the folded second side of the packaging wrap.

8. Method according to claim 7, including tucking an end of the folded second corner of the packaging wrap under one of the folded second side of the packaging wrap and the folded first side of the packaging wrap.

9. Method according to claim 2, wherein said corner is a first corner, said packaging wrap possessing second, third and fourth corners, said step of folding the second portion of the packaging wrap including folding said fourth corner inwardly towards the folded first corner, said fourth corner being located opposite said first corner, said step of folding the third portion of the packaging wrap including folding said second corner inwardly towards said third corner, said step of folding the fourth portion of the packaging wrap including folding said third corer inwardly towards said folded second corner, said second and third corners being located opposite one another.

10. Method according to claim 9, including folding a portion of the first corner back upon itself to form a pull-out flap.

11. Method according to claim 1, including folding a portion of said corner back upon itself to form a pull-out flap.

12. Method according to claim 1, wherein the packaging wrap includes a center and said step of placing the heel of bread on the flat sheet of packaging wrap includes placing the heel of bread at a position offset from the center of the packaging wrap.

13. Method by which a preparer wraps a sandwich product that includes a first piece of bread product and a second piece of bread product, comprising:

placing a sheet of packaging wrap on a surface, the packaging wrap having a plurality of corners, said packaging wrap being oriented relative to the preparer so that one of said corners points at the preparer;

placing the first piece of bread product on the packaging wrap;

placing the second piece of bread product on the packaging wrap;

performing a first folding step involving folding a first portion of the packaging wrap along with the second piece of bread product to position the second piece of bread product and the first piece of bread product in overlying relation to one another and with the first portion of the packaging wrap being folded with respect to a remainder of the packaging wrap so that the first portion of the packaging wrap is positioned against the second piece of bread product;

performing a second folding step to position a second portion of the packaging wrap adjacent the folded first portion of the packaging wrap; and performing a third folding step to position a third portion of the packaging wrap adjacent the folded second portion of the packaging wrap.

14. Method according to claim 13, including performing a fourth folding step to position a fourth portion of the packaging wrap to lie adjacent the folded third portion of the packaging wrap so that the third portion of the packaging wrap is located between the second portion of the packaging wrap and the fourth portion of the packaging wrap.

15. Method according to claim 13, including dressing at least one of the first piece of bread product and the second piece of bread product with food product after placing the first piece of bread product on the packaging wrap.

16. Method according to claim 13, wherein the packaging wrap includes a center and said step of placing the first piece of bread product on the flat sheet of packaging wrap includes placing the first piece of bread product substantially in a center of the packaging wrap.

17. Method according to claim 15, wherein the packaging wrap includes a center and said step of placing the first piece of bread product on the flat sheet of packaging wrap includes placing the first piece of bread product at a position offset from the center of the packaging wrap.

18. Method according to claim 13, wherein the first portion of the packaging wrap includes said one corner so that during said first folding step said one corner is folded together with said second piece of bread product.

19. Method according to claim 14, wherein said fourth folding step includes turning over onto the fourth portion of the packaging wrap the first and second pieces of bread along with the folded first, second and third portions of the packaging wrap so that the first and second pieces of bread and the first, second and third portions of the packaging wrap overlie the fourth portion of the packaging wrap.

20. Method according to claim 13, wherein said packaging wrap has a plurality of sides including oppositely located first and second sides, said one corner being a first corner and said packaging wrap having a second corner located opposite said first corner, a distance between the first and second corners being greater than a distance between the first and second sides.

21. Method according to claim 14, including tucking and end of the folded fourth portion of the packaging wrap between the folded first portion of the packaging wrap and the folded second portion of the packaging wrap.

22. Method according to claim 14, wherein said one corner is a first corner and said packaging wrap includes second, third and fourth corners, said second folding step including inwardly folding said fourth corner towards the first corner, said fourth corner being located opposite said first corner, said third folding step including inwardly folding said second corner towards said third corner, said fourth folding step including inwardly folding said third corner towards said folded second corner, said second and third corners being located opposite one another.

23. Method according to claim 22, including folding a portion of the first corner backwards upon itself to form a pull-out flap.

24. Method by which a preparer wraps a sandwich product, comprising:

placing a flat sheet of packaging wrap on a surface, said flat sheet of packaging wrap including at least one corner, said flat sheet of packaging wrap being positioned on the surface so that said corner points at the preparer;

placing a first piece of bread product on a flat sheet of packaging wrap;

placing a second piece of bread product on a first portion of the flat sheet of packaging wrap located adjacent said corner;

inwardly folding said first portion of the packaging wrap, including said corner, together with the second piece of bread product to position the second piece of bread product and the first piece of bread product in overlying relation to one another to form a sandwich product and with said first portion of the packaging wrap being positioned in overlying relation to the sandwich product;

inwardly folding a second portion of the packaging wrap;

inwardly folding a third portion of the packaging wrap.

25. Method according to claim 24, including folding a part of one of said first, second and third portions backwards upon itself to form a pull-out flap.

26. Method according to claim 24, including tucking and end of one of the folded portions under another one of the folded portions to form a pull-out flap.

27. Method for wrapping sandwich products that include a heel of bread and a crown of bread, comprising:

placing a flat sheet of packaging wrap on a surface, said flat sheet of packaging wrap having oppositely located first and second corners and oppositely located first and second sides, said packaging wrap being configured to have dimensions such that the dimension between said first and second corners is greater than the dimension between said first and second sides;

placing a first piece of bread product on the packaging wrap;

placing a second piece of bread product on the flat sheet of packaging wrap at a first portion of the packaging wrap located adjacent said first corner;

folding said first portion of the packaging wrap along with the second piece of bread product to position the second piece of bread product on top of the first piece of bread product to form a sandwich product and with said first portion of the packaging wrap being positioned on top of the sandwich product;

folding a second portion of the packaging wrap; and folding a third portion of the packaging wrap.

28. Method according to claim 29, including inwardly folding a fourth portion of the packaging wrap towards the folded first portion, said fourth portion of the packaging wrap including said second corner, and tucking and end of the folded fourth portion of the packaging wrap under another one of the folded portions of the packaging wrap.

* * * * *